United States Patent [19]

Simmons, Jr.

[11] 4,176,692

[45] Dec. 4, 1979

[54] ROTATING DRIVING MECHANISM FOR IMPARTING RECIPROCATORY MOTION TO A DRIVEN ELEMENT

[75] Inventor: James W. Simmons, Jr., Atlanta, Ga.

[73] Assignee: Cox Foundry & Machine Co., Atlanta, Ga.

[21] Appl. No.: 935,362

[22] Filed: Aug. 21, 1978

[51] Int. Cl.[2] ..... D03D 39/18

[52] U.S. Cl. ..... 139/21; 139/449

[58] Field of Search ..... 139/21, 291 C, 441, 139/449; 74/25, 47, 603

[56] References Cited

U.S. PATENT DOCUMENTS

| | | | |
|---|---|---|---|
| 1,261,053 | 4/1918 | O'Brien | 74/603 |
| 1,261,527 | 4/1918 | Herthel | 74/603 |
| 2,258,193 | 10/1941 | Payne | 139/449 |
| 2,890,725 | 6/1959 | Brannock | 139/449 |
| 3,335,760 | 8/1967 | Scheffel | 139/449 |
| 3,394,739 | 7/1968 | Crenshaw et al. | 139/21 |
| 3,955,603 | 5/1976 | Martelli | 139/449 |

*Primary Examiner*—Henry Jaudon

*Attorney, Agent, or Firm*—Walter M. Rodgers; Walter A. Rodgers

[57] ABSTRACT

A driving mechanism comprises a rotatable shaft (34), a drive arm (56) mounted on and rotatable with said drive shaft and having a swing end projecting radially therefrom on which a counterbalanced drive link (63) is rotatably mounted and arranged to rotate in a plane parallel to the plane of rotation of the drive arm, means (65,66,67,68,69) for rotating said drive link in a direction which is opposite to that of said drive arm, balance means (71) forming a part of said drive arm and rotatable therewith about said drive shaft so as to counterbalance the weight of said drive arm (56) and drive link (63) irrespective of the angular position of said drive link (63) relative to said drive arm (56) and a pair of flexible cables (W1,W2), each interconnected at one end with a driven element (C) to be reciprocated and each being secured at its other end with a fixed element (51,54) and the intermediate portions of said links being looped about pulley means (50) mounted on the swing end of said drive link (63) in such manner as to define a plurality of courses (*a*1,*a*2,*b*1,*b*2) whereby the travel of the driven element (C) is amplified relative to the straight line reciprocation of the pulley means (50).

3 Claims, 9 Drawing Figures

ROTATING DRIVING MECHANISM FOR IMPARTING RECIPROCATORY MOTION TO A DRIVEN ELEMENT

TECHNICAL FIELD

This invention relates to a motion converting driving mechanism for deriving reciprocatory motion from a rotatable driving means.

BACKGROUND ART

Known reciprocatory means for cutting the pile of a double pile fabric utilizes an oscillatory segment having teeth about its peripheral portion which cooperate with teeth on a reciprocal rack together with flexible cables which are interconnected with pile cutting knife means to impart reciprocation to the pile cutting knife. Wear of the parts may result in excessive noise and vibration.

DISCLOSURE OF INVENTION

Double pile looms must be provided with a pile cutting device which is arranged to move in a reciprocatory motion across the loom. Reciprocatory motion can be derived from known mechanisms but such mechanisms may require substantial space and may develop objectionable vibration and noise particularly after the parts become worn.

According to this invention in one form, a shaft of a loom serves as a support for a rotatable drive arm on whose swing end a counterbalanced drive link is rotatably mounted and arranged to rotate in the opposite direction from the direction of rotation of the drive arm and in a plane parallel therewith. Such action is well known but may be accompanied by significant vibration. Thus a counterweight is provided according to one feature of this invention and is supported by a radial balance arm which preferably is integrally formed with the drive arm so that the drive link and drive arm are effectively counterbalanced irrespective of the angular position of the drive link relative to the drive arm. Known means interrelates the drive arm and the drive link in such manner as to cause these elements to rotate in opposite directions so that the swing end of the drive link reciprocates in a straight line.

In order to impart reciprocatory motion to a pile cutting knife slidably mounted on the loom beam, a flexible cable is connected at one end to the knife and at the other end to a fixed element, the intermediate portion of the flexible cable being looped about pulley means mounted on the swing end of the drive link in such manner as to form a plurality of courses which effectively amplify the distance of travel of the cutter element relative to the distance of reciprocatory motion of the pulley means. In like fashion and in order to drive the cutter knife in the opposite direction a second cable is connected at one end with the cutter means and at the other end with a fixed element and arranged so that its intermediate portion is looped about the puley means in such manner as to provide a plurality of distance amplifying courses whereby the travel of the cutter knife in the opposite direction is effected. This distance amplifying feature of the invention allows the drive arm and the associated radial balance arm and counterweight to be constructed in a relatively compact space-saving fashion. Furthermore the fact that the counterbalance feature is employed substantially reduces and may virtually eliminate vibration and noise.

BRIEF DESCRIPTION OF THE DRAWINGS

In the drawings

FIG. 8 is a schematic view similar in some respects to FIG. 2 and which shows an arrangement in which four courses are used for distance amplification and in which

BEST MODE FOR CARRYING OUT THE INVENTION

Figure 1:
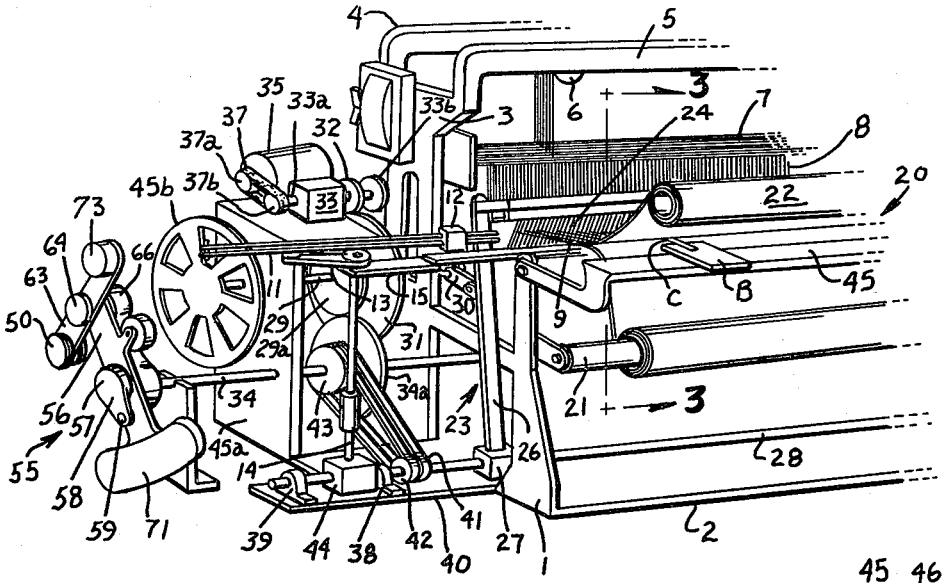
FIG. 1 is a somewhat schematic perspective view of one end of a loom to which the invention is applicable.

In the drawings the numeral 1 designates a vertically disposed upright frame element which is secured to a horizontally disposed frame element 2. Integral with vertical frame element 1 is a frame element 3 to the upper parts of which horizontally disposed arch frame elements 4 and 5 are secured.

Conventional warp shed forming means comprises a plurality of sheaves 6 which are rotatably supported in known manner by the arches 4 and 5 and which control vertically reciprocatory motion of harness elements 7 and their associated heddles 8 by which the warp threads 9 are controlled in known manner so as to form warp sheds in sequence.

For the purpose of inserting the weft threads into the warp sheds, rapiers 10 and 11 are reciprocably operated into and out of the shed and are disposed on either side of the loom although FIG. 1 discloses only one end of a loom. Operating movement of the swords 10 and 11 is controlled by guides generally designated at 12.

Operating movement is imparted to rapiers 10 and 11 by weft inserting means generally designated by the numeral 13 which is driven by rotatable shaft 14 journally related with support means 15.

For a more complete description of the structure and operation of weft inserting means 13, reference may be had to U.S. Pat. No. 3,335,760 issued Aug. 15, 1967 and captioned "Gripper Loom".

As is well understood, a weft thread connected to the inner end of a rapier such as 10 is fed into the shed approximately half way across and is transferred to a corresponding rapier which enters the shed from the opposite side and which when retracted completes the travel of the weft thread across the shed. Thus sequential formation of sheds followed by synchronous insertion of the rapiers such as 10 and 11 results in the weaving of a double pile cloth designated in FIG. 1 by the numeral 20 and which is cut into two single thickness layers. The lower layer is wound on the horizontal loom roler 21 and the upper layer is wound on roller 22.

In order to beat-up the weft threads into the finished body of the cloth 20, lay means generally designated by the numeral 23 is employed. Lay means 23 includes reed structure 24 mounted atop beam 25 which is secured to vertical support element 26 which in turn is oscillatable through bearing structure 27 on rotatable shaft 28. A corresponding element such as 26 is not shown but is disposed at the right hand end of the loom as viewed in FIG. 1.

For the purpose of imparting oscillatory beat-up motion to the lay means 23 about shaft 28 as a center, a crank shaft 29 is interconnected at 30 with element 26. Shaft 29 is mounted in bearings (not shown) which are secured in any suitable manner to the frame structure of the loom. Rotary motion is imparted to shaft 29 by any suitable means such as driven gear 31 secured to shaft 29 and which cooperates with a driving gear 32 fixedly mounted on shaft 33*a* of clutch 33 coupled with motor 35 by belt or chain 37 and associated pulleys or pinions 37*a* and 37*b*. Motor 35 is secured to the frame structure in any suitable manner and is controlled by control means 36 also mounted to the frame of the machine. A brake 33*b* is arranged to cooperate with shaft 33*a* to aid in arresting rotation of gear 32 and associated parts.

Shaft 28 is rotated in synchronism with the lay although this shaft is not directly coupled with the lay means. Thus the crank shaft 29 is coupled with shaft 34 through driving gear 29*a* secured to shaft 29 and driven gear 34*a* secured to shaft 34, the gears 29*a* and 34*a* being in meshed relation with each other and the number of teeth on gear 34*a* being twice that of gear 29*a*. Shaft 34 is rotatably mounted in bearings (not shown) but which are secured to the machine frame. As is apparent from the drawings, rotation of motor 35 and of clutch 33 drives gears 32 and 31 and in turn rotates shaft 29, gears 29*a* and 34*a* and shaft 34. Rotation of shaft 34 imparts rotation to shaft 28 through chain 41 and sprockets 42 and 43. Sprocket 43 is twice as large in diameter as sprocket 42.

Shaft 28 is mounted in fixed bearings 38 and 39 which are secured to base plate 40 which is fixed in position with respect to frame 1 and which conveniently may rest on the supporting floor. Interconnection between rotatable shaft 28 and rotatable shaft 34 and all of the mechanism associated with the lay means is effected by means of a lay coupling double chain designated by the numeral 41 which cooperates with the sprocket 42 affixed to shaft 28 and the sprocket 43 affixed to shaft 34. Thus rotation of shaft 28 is in coordination with operation of the lay means 23 and is effected by lay coupling means in the form of chain 41 and sprockets 42 and 43.

For the purpose of imparting operating rotation to shaft 14, a gear box 44 is coupled with shaft 28 and constitutes, together with shaft 14, weft inserting coupling means whereby shaft 28 is coupled with weft inserting means. Gear box 44 includes meshing pinions one of which is affixed to shaft 28 and the other of which is affixed to shaft 14. These pinions are of the same size.

For controlling the operation of the loom manually, a wheel 45*b* is mounted on crank shaft 29.

While the invention is shown in the drawings as applied to a shuttleless loom in which reciprocable rapiers are used, it will be understood that the invention is also applicable to shuttle type tape and other types of looms. In addition it is apparent that the motion derived according to this invention is not limited in its application to cutter means for looms but may be employed for other purposes as well.

Figure 2:
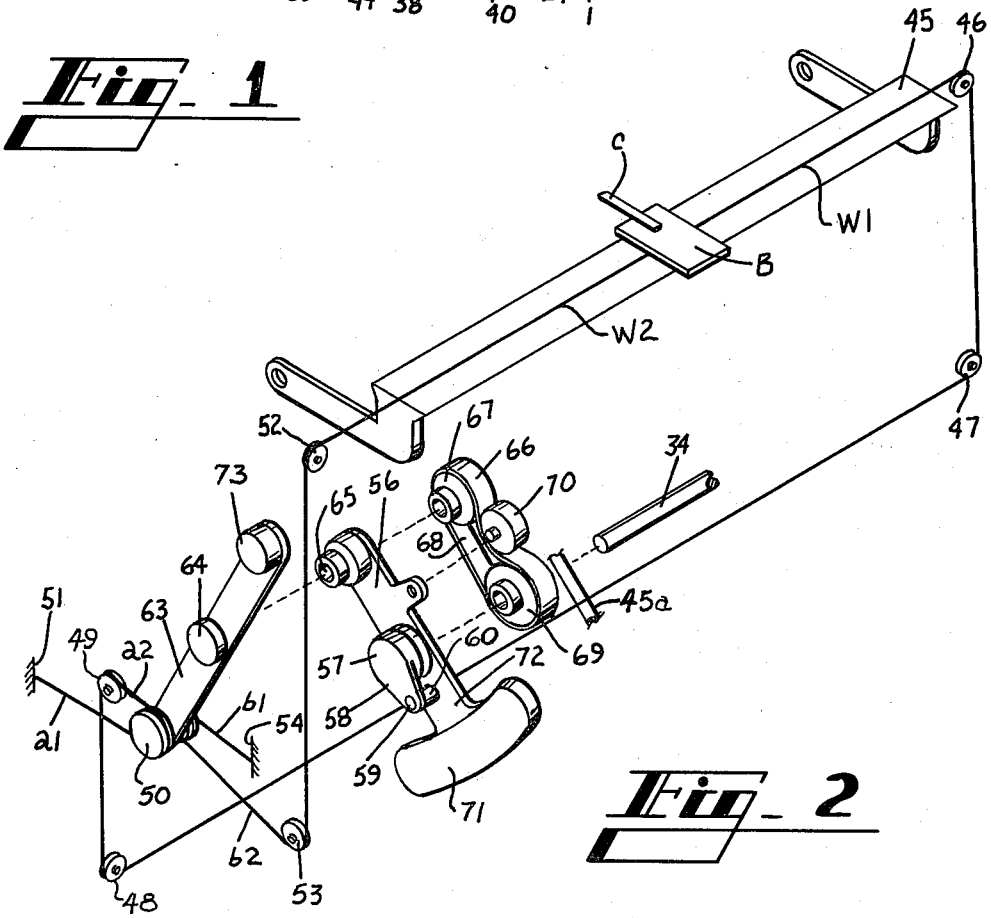
FIG. 2 is a schematic system arrangement which indicates the relationship between the principal parts of the invention and the reciprocable cutter element driven by the mechanism of this invention.
Figure 3:
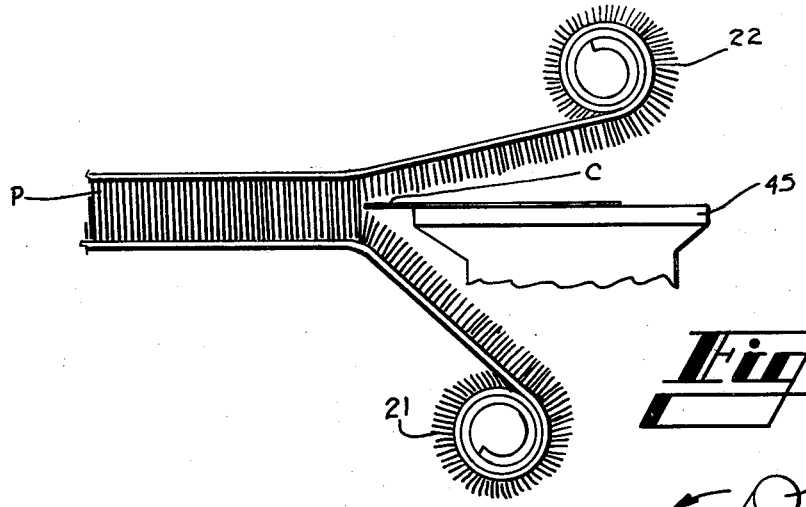
FIG. 3 is a schematic cross sectional view taken along the line generally designated 3—3 in FIG. 1.

For the purpose of cutting the pile P of double pile fabric as schematically represented in FIG. 3, a cutter element C and its base B are reciprocably mounted for sliding movement along a support element 45. In order to drive the cutter C and its associated base B toward the right, a flexible cable or wire W1 is secured to base B and looped about pulleys 46, 47, 48, and 49 and in turn about pulley means 50 and arranged with its other end securely anchored to fixed element 51. Thus motion of pulley means 50 toward the right as viewed generally in FIGS. 1 and 2 imparts a tension force to cable W1 which drives the cutter C and its base B toward the right. The distance of travel of cutter C toward the right is amplified due to the fact that the looping of the intermediate portion of cable W1 around pulley means 50, provides a pair of generally parallel courses a1 and a2. Thus movement toward the right of pulley means 50 a certain distance effectively moves the cable W1 twice that distance due to the doubling action or the distance amplifying action of courses a1 and a2

For the purpose of moving the cutter C and its base B toward the left, a second cable or wire W2 is connected at one end to base B and looped about fixed pulleys 52,53 and pulley means 50 to fixed element 54 to which the end of wire W2 is secured. This action defines courses b1 and b2 which effectively double the motion imparted to cable or wire W2 due to motion of pulley means 50 which is generally toward the left as viewed in FIG. 1.

Figure 9:
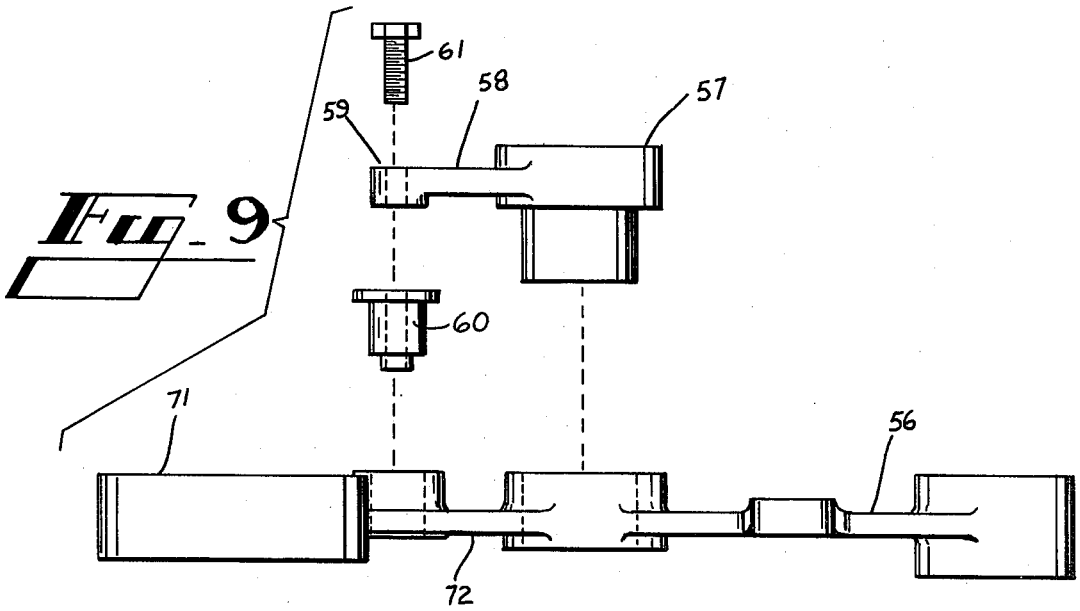
FIG. 9 represents an exploded arrangement of mechanism for disjointably coupling the drive arm of this invention with the loom shaft.

For the purpose of imparting reciprocatory motion which is in a straight line to the pulley means 50, the mechanism generally designated by the numeral 55 in FIG. 1 and which is shown in exploded schematic form in FIG. 2 is employed. As is best shown in FIGS. 1 and 2, a drive arm 56 is mounted on hub 57 which in turn is fixedly mounted to shaft 34 by a slot and key arrangement so that hub 57 rotates with shaft 34. Hub 57 is provided with a part 58 having a cavity 59 formed therein in which a driving stud 60 is disposed. Driving stud 60 is secured against rotation with the drive arm 56 by a cap screw 61 as is best shown in FIG. 9. Thus rotation of shaft 34 imparts rotation to drive arm 56.

Drive link 63 is oscillatably mounted at its center 64 to a pin 65 mounted on the swing end of drive arm 56. As is apparent in the drawings, pulley means 50 is mounted on the swing end of drive link 63 for straight line reciprocable movement and a counterbalance weight 73 is mounted on the opposite end of drive link 63.

For the purpose of imparting oscillatory motion to the drive link 63 about its center of oscillation 65, a toothed belt 66 is arranged to cooperate with a cog 67 securely affixed to pin 65. A driving belt 68 cooperates with the teeth (not shown) of cog 67 and also cooperates with teeth (not shown) formed on fixed cog 69 secured to mounting plate 45*a* so that rotation of drive arm 56 causes rotation of drive link 63 due to the action of belt 66 in accordance with U.S. Pat. No. 3,335,760. Belt 66 is held in tightened condition by an idler pulley 70.

Figure 4:
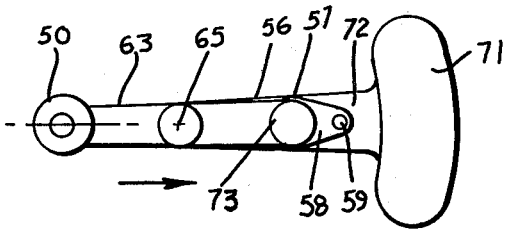
FIGS. 4,5,6 and 7 are schematic views which represent positions of the components of the driving mechanism as the mechanism moves through 180°.
Figure 5:
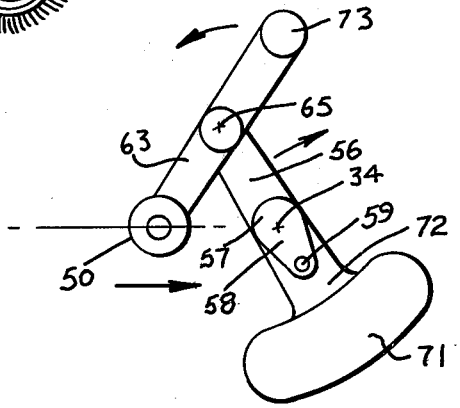
Figure 6:
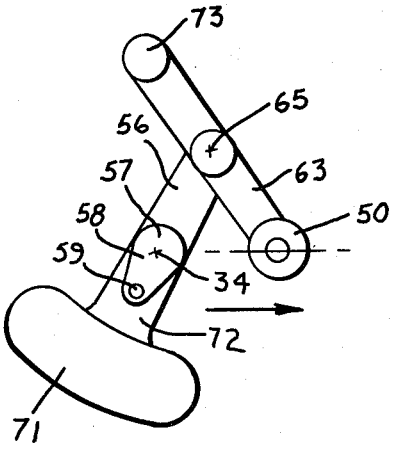
Figure 7:
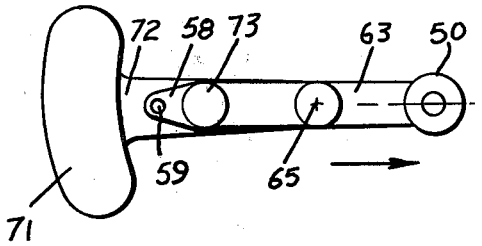

From the description thus far, it is apparent that oscillation of drive arm 56 in one direction such as the clockwise direction imparts rotation to drive link 63 which is in opposite direction as is best represented by FIGS. 4, 5, 6 and 7. In FIG. 4 drive arm 56 is shown in a horizontal position and with its swing end including the pin 65 toward the left of shaft 34. Drive link 63 in FIG. 4 is shown in alignment with drive arm 56 and with the pulley means 50 in an extreme left hand position. FIG. 5 represents a condition 45° later after drive arm 56 has moved through 45° in the clockwise direction. This action has caused drive link 63 to swing through an angle of 45° in the counterclockwise direction. Ninety degrees later positions are represented by FIG. 6 and after 180° of arcuate movement of drive arm 56 in a clockwise direction about shaft 34 as a center, the parts occupy the positions represented in FIG. 7. Thus from FIGS. 4, 5, 6 and 7, it is apparent that pulley means 50 has moved in a translatory straight line direction from the position represented in FIG. 4 to that represented in FIG. 7. Furthermore it is apparent that the distance of travel is twice the distance represented by the length of drive arm 56 from the center of rotation of shaft 34 to the center of rotation of pin 65 plus the distance from the center of rotation of pin 65 and of pulley means 50 which constitutes the effective length of drive link 63. Thus if these parts of drive arm 56 and of drive link 63 which are equal are eleven inches each, the total travel from left to right of pulley means 50 is 22 inches from the position indicated in FIG. 4 to that indicated in FIG. 7.

For the purpose of minimizing or eliminating vibration of the parts, drive arm balance means is provided and comprises weight 71 which is mounted on the swing end of a radial balance arm 72. According to a feature of this invention, the effective counterbalancing action of counterbalance means including weight 71 and radial balance arm 72 is such as effectively to conterbalance the weight of drive arm 56 and of drive link 63 irrespective of the angular position of drive link 63 relative to drive arm 56. Of course this is due in part to the fact that a counterbalancing weight 73 is mounted at the swing end of radial balance arm 74 which is integrally formed with drive link 63.

As explained in connection with FIGS. 4–7 inclusive, if the effective travel of pulley means 50 from left to right as represented by the travel from FIG. 4 to FIG. 7 is 22 inches, the arrangement shown in FIG. 2 effectively doubles that travel due to the generally parallel courses a1, a2, b1, and b2 so that with the arrangement shown in FIG. 2 the total travel of the cutter means C and its base B would be 44".

Figure 8:
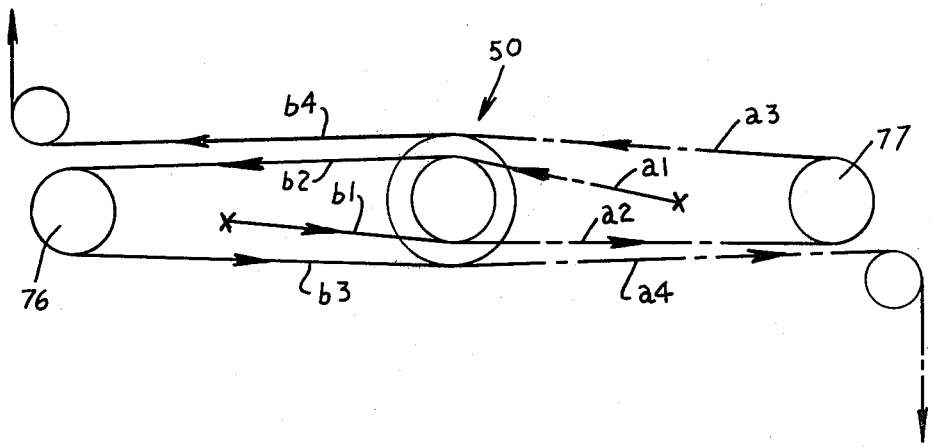

For most applications of the invention a greater degree of travel is necessary. Thus the arrangement of FIG. 8 may be employed wherein four courses are utilized and represented by the letters a1, a2, a3, and a4 for one cable such as W1 for example while separate course b1, b2, b3 and b4 are employed for the other cable such as W2. The arrangement of FIG. 8 obviously requires the addition of a pair of fixed pulleys such as those designated by the numerals 76 and 77. Thus with the four courses associated with each cable as represented in FIG. 8, the travel which in the example discussed above of 44 inches would be multiplied so that such total travel in each direction is 88". Of course the arrangement of FIG. 8 requires the addition of two more pulleys to the swing end of drive link 63 and these preferably would be arranged so that some of the pulleys are on one side of the arm 63 while other pulleys are on the other side so as effectively to balance that arrangement against undesired twisting action which probably would result if all the pulleys were on one side of the drive link.

As is apparent from FIG. 9, the arrangement lends itself for ready disconnection so that the drive mechanism generally represented by 55 may be disconnected from the hub 57 by simply unscrewing the cap screw 61 which in turn accommodates ready removal of the driving stud 60 as is apparent. With the cap screw removed, the driving stud is simply removed from the cavity 59 formed in drive arm 56 and hub 57 is uncoupled from drive arm 56. By this means, it is possible to operate the loom as may be desired without operating the reciprocable cutter C and its base B.

INDUSTRICAL APPLICABILITY

It is apparent from the above description that this invention is primarily intended for application to double pile looms and that the invention minimizes or eliminates the difficulties which have attended prior art devices utilizing an oscillatory arcuate segment having teeth about its periphery and arranged to cooperate with a rack which in turn is connected with cables trained over large diameter pulleys in such manner as to impart reciprocatory motion to a cutter and its base. The invention is particularly well adapted to minimize or substantially eliminate noise and vibration which invariably attends wearing of the teeth of the oscillatory segment and rack of prior known devices. While the invention is intended primarily for use as a driving means for cutters of double pile looms, it is clear that it is not limited to this particular application and may have many other applications as well.

The embodiments of the invention in which an exclusive property or privlege is claimed are defined as follows:

1. A rotatable driving mechanism for impartingreciprocatory movement to a driven member (C), said mechanism comprising a rotatable drive shaft (34), a drive arm (56) mounted on and rotatable with said drive shaft (34) and having a swing end projecting radially therefrom, a drive link (63) oscillatably mounted on the swing end of said drive arm and having a swing end arranged to oscillate in a plane parallel to the plane of rotation of said drive arm and about a center of oscillation (64) which is movable with said drive arm, means (66–70) for imparting oscillation to said drive link (63) which is in synchronism with rotation of said drive arm (56) and wherein the improvement comprises counterbalance means (71,72) projecting from said drive arm (56) and rotatable therewith about said drive shaft (34) and arranged to counterbalance the total weight of said drive arm (56) and of said drive link (63) irrespective of the angular position of said drive link (63) relative to said drive arm (56), and drive link balance means (73) projecting from said drive link (63) and disposed in alignment therewith so as effectively to counterbalance said drive link for oscillation about its center of oscillation (64).

2. A rotatable driving mechanism for imparting reciprocatory movement to a driven member (C), said mechanism comprising a rotatable drive shaft (34), a drive arm (56) mounted on and rotatable with said drive shaft (34) and having a swing end projecting radially therefrom, a drive link (63) oscillatably mounted on the swing end of said drive arm and having a swing end arranged to oscillate in a plane parallel to the plane of rotation of said drive arm and about a center of oscillation (64) which is movable with said drive arm, means (66-70) for imparting oscillation to said drive link (63) which is in synchronism with rotation of said drive arm (56) and wherein the improvement comprises counterbalance means (71,72) projecting from said drive arm (56) and rotatable therewith about said drive shaft (34) and arranged to counterbalance the total weight of said drive arm (56) and of said drive link (63) irrespective of the angular position of said drive link (63) relative to said drive arm (56), a hub (57) keyed to said drive shaft (34) and arranged to support said drive arm (56), and a driving stud (60) disjointably interconnecting a part of said hub with a part of said drive arm.

3. A mechanism according to claim 2 wherein said driving stud (60) is disposed within a cavity (59) formed in said drive arm (56) and is secured therein by a fastening element (61) which is threadedly connected with a part of said hub (57).

* * * * *